US012622463B2

(12) United States Patent
Dai et al.

(10) Patent No.: US 12,622,463 B2
(45) Date of Patent: May 12, 2026

(54) HEATING ASSEMBLY AND LOW-TEMPERATURE SMOKING SET

(71) Applicant: SHENZHEN FIRST UNION TECHNOLOGY CO., LTD., Shenzhen City (CN)

(72) Inventors: Chenpan Dai, Shenzhen City (CN); Zhongli Xu, Shenzhen City (CN); Yonghai Li, Shenzhen City (CN)

(73) Assignee: SHENZHEN FIRST UNION TECHNOLOGY CO., LTD., Shenzhen City (CN)

( * ) Notice: Subject to any disclaimer, the term of this patent is extended or adjusted under 35 U.S.C. 154(b) by 547 days.

(21) Appl. No.: 17/793,395

(22) PCT Filed: Jan. 15, 2021

(86) PCT No.: PCT/CN2021/072139
§ 371 (c)(1),
(2) Date: Jul. 16, 2022

(87) PCT Pub. No.: WO2021/143839
PCT Pub. Date: Jul. 22, 2021

(65) Prior Publication Data

US 2023/0055965 A1 Feb. 23, 2023

(30) Foreign Application Priority Data

Jan. 16, 2020 (CN) ..... 202020094140.0

(51) Int. Cl.
*A24F 40/465* (2020.01)
*A24F 40/20* (2020.01)

(52) U.S. Cl.
CPC ..... *A24F 40/465* (2020.01); *A24F 40/20* (2020.01)

(58) Field of Classification Search
None
See application file for complete search history.

(56) References Cited

U.S. PATENT DOCUMENTS 5,967,148 A 10/1999 Harris et al.
2016/0255879 A1* 9/2016 Paprocki ..... A24F 40/46
(Continued)

FOREIGN PATENT DOCUMENTS

CN 206260851 U 6/2017
CN 109380766 A 2/2019
(Continued)

*Primary Examiner* — Philip Y Louie
(74) *Attorney, Agent, or Firm* — Cheng-Ju Chiang

(57) ABSTRACT

The present invention provides a heating assembly and a low-temperature smoking set, wherein the heating assembly comprises a heating body and a cavity for containing at least a part of the cigarette, the heating body comprises a base, an infrared radiation layer and an electrode, the base comprises a surface, the infrared radiation layer is arranged on the surface for generating infrared radiation to heat at least a part of the cigarette located in the cavity; at least a part of the electrode is recessed from the surface and buried in the base so that the electrode and the base are formed into an integral structure, and the electrode is electrically connected with the infrared radiation layer. The present utility model well prevents the infrared radiation layer from being scraped off and prevents the electrode from falling off.

15 Claims, 5 Drawing Sheets

(56) References Cited

U.S. PATENT DOCUMENTS

| | | | | |
|---|---|---|---|---|
| 2018/0049469 | A1* | 2/2018 | Kaufman | G01D 5/24 |
| 2018/0168224 | A1* | 6/2018 | Naughton | A24F 40/40 |

FOREIGN PATENT DOCUMENTS

| | | | |
|---|---|---|---|
| CN | 208863605 | U | 5/2019 |
| CN | 109846093 | A | 6/2019 |
| CN | 110384264 | A | 10/2019 |
| CN | 211910551 | U | 11/2020 |

* cited by examiner

HEATING ASSEMBLY AND LOW-TEMPERATURE SMOKING SET

CROSS REFERENCE TO RELATED APPLICATIONS

The present application is a 35 U.S.C. § 371 National Phase conversion of International (PCT) Patent Application No. PCT/CN2021/072139, filed on Jan. 15, 2021, which claims priority to Chinese Patent Application No. 202020094140.0, filed with the Chinese Patent Office on Jan. 16, 2020, titled "HEATING ASSEMBLY AND LOW-TEMPERATURE SMOKING SET", the entire contents of which are incorporated herein by reference. The PCT International Patent Application was filed and published in Chinese.

TECHNICAL FIELD

The present invention relates to the technical field of low-temperature smoking sets, and in particular, relates to a heating assembly and a low-temperature smoking set.

BACKGROUND

Traditional cigarettes made of tobacco needs to be ignited by open fire and burned to produce smoke. In the process of high-temperature heating and pyrolysis, tobacco releases thousands of mixed substances harmful to human body, which are composed of volatile substances existing in gas and semi-volatile and non-volatile substances existing in particles, such as carbon monoxide, phenols, aldehydes, nicotine (nicotinamide), cigarette tar or the like. In contrast, low-temperature cigarettes can effectively reduce the generation of harmful substances and thus be healthier.

Therefore, low-temperature smoking sets came into being. Common low-temperature smoking sets currently available are generally divided into central heating type and circumferential heating type. General structures thereof are as follows: a cigarette accommodating cavity is arranged in the smoking set, and the heating body is either located in the cigarette accommodating cavity (for the central heating type) in which the heating body needs to be inserted into the cigarette when the cigarette is to be heated, or located around the cigarette accommodating cavity (for the circumferential heating type) in which the heating body is located around the cigarette (i.e., the cigarette is placed inside the heating body) when the cigarette is to be heated. During use, the heating body is supplied with power to generate heat so as to heat the cigarette in the cigarette accommodating cavity.

The low-temperature smoking sets of the circumferential heating type which are currently available usually comprise a heating tube, and the peripheral surface of the heating tube is provided with a layer of electro-heating coating film and electrodes sleeved on the coating film. The electrodes are in interference fit with the coating film and are used for conveying electric energy to the coating film. However, in the process of assembling the electrodes, the coating film is likely to be scraped off so that the electrical connection is unreliable, and the electrode is likely to fall off.

SUMMARY

In order to solve the problems in the prior art, the present utility model provides a heating assembly with reliable electrical connection of electrodes and a low-temperature smoking set.

In a first aspect, the present utility model provides a heating assembly for baking a cigarette, wherein the heating assembly comprises a heating body and a cavity for containing at least a part of the cigarette, the heating body comprises a base, an infrared radiation layer and electrodes, the base comprises a surface, the infrared radiation layer is arranged on the surface for generating infrared radiation to heat at least a part of the cigarette located in the cavity; at least a part of the electrode is recessed from the surface and buried in the base, so that the electrode and the base are formed into an integral structure, and the electrode is electrically connected with the infrared radiation layer.

Preferably, the infrared radiation layer covers at least a part of the electrode so as to be electrically connected with the electrode.

Preferably, at least a part of the electrode has a side that is substantially aligned with the surface of the base.

Preferably, the electrode comprises an electrical connection part for providing conductive connection between the heating assembly and other members, and the electrical connection part protrudes from the surface relative to the base.

Preferably, the base is tubular with the cavity formed inside, and the outer surface of the base is configured as the surface, and the electrical connection part forms a flange around the outer surface of the base.

Preferably, the electrode has an opening to form a non-closed ring shape.

Preferably, the base is tubular with the cavity formed inside, and the inner surface of the base is configured as the surface, and at least a part of the electrode penetrates through the inner surface of the base and extends to the outer surface of the base.

Preferably, the electrode comprises an annular body and a tab, and the body is recessed from the inner surface of the base and buried in the base; the tab is connected with the body, penetrates through the outer surface of the base and protrudes from the outer surface.

Preferably, the number of the electrodes is two, and the two electrodes are correspondingly located at opposite ends of the base.

In a second aspect, the present utility model further provides a low-temperature smoking set which comprises a housing assembly and a heating assembly, the heating assembly is accommodated in the housing assembly, wherein the heating assembly is the heating assembly according to any item of the first aspect described above.

The present utility model has the following beneficial effects: according to the present utility model, the base, the infrared radiation layer and the electrodes cooperate with each other, the base comprises a surface, the infrared radiation layer is arranged on the surface, and at least a part of the electrode is recessed from the surface and buried in the base so that the electrode and the base are form into an integral structure; during production, first the electrode and the base are integrally formed, and then the infrared radiation layer is formed on the base, thereby well preventing the infrared radiation layer from being scraped off and preventing the electrodes from falling off, and providing reliable electrical connection of the electrodes.

BRIEF DESCRIPTION OF THE DRAWINGS

One or more embodiments are illustrated by pictures in corresponding attached drawings, and this does not constitute limitation on the embodiments. Elements with the same reference numerals in the attached drawings are shown as similar elements, and the pictures in the attached drawings do not constitute scale limitation unless otherwise stated particularly.

DETAILED DESCRIPTION

Figure 1:
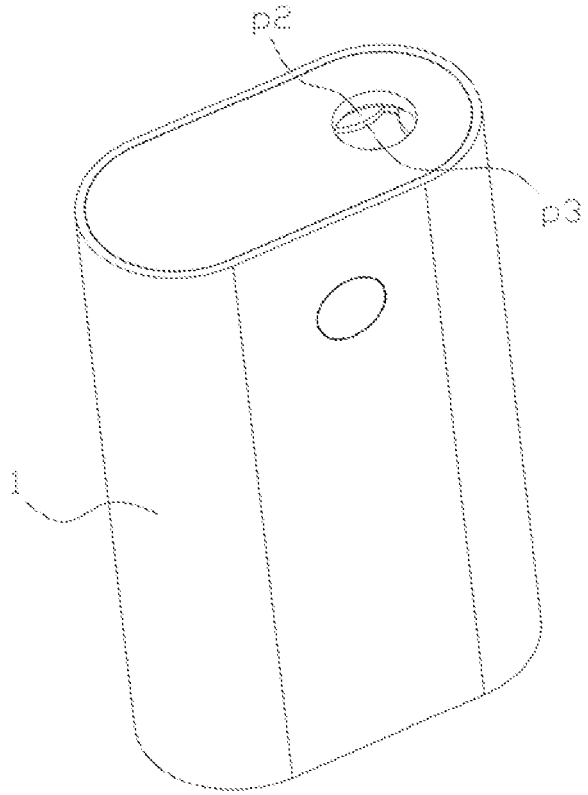
FIG. 1 is a perspective view of a low-temperature smoking set provided according to an embodiment of the present utility model.
Figure 2:
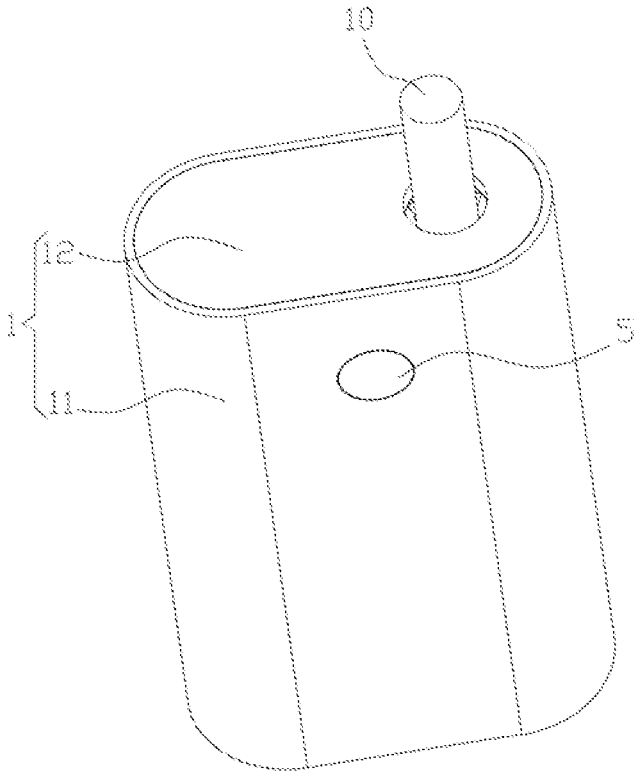
FIG. 2 is a perspective view of the low-temperature smoking set shown in FIG. 1 with a cigarette inserted therein.
Figure 3:
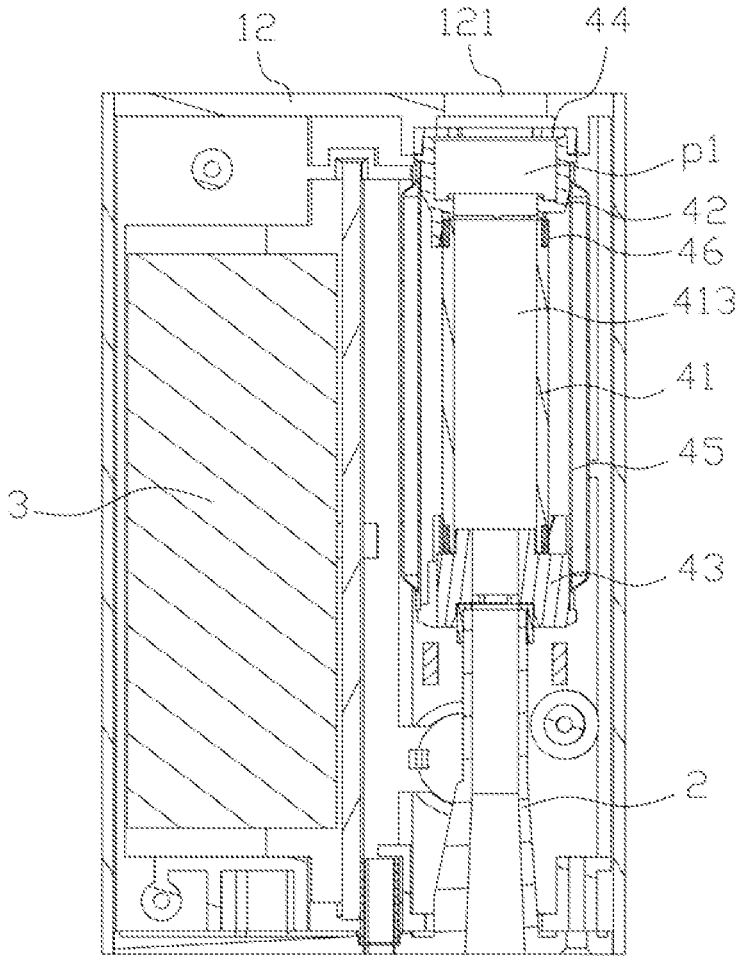
FIG. 3 is a cross-sectional view of the low-temperature smoking set shown in FIG. 1.
Figure 4:
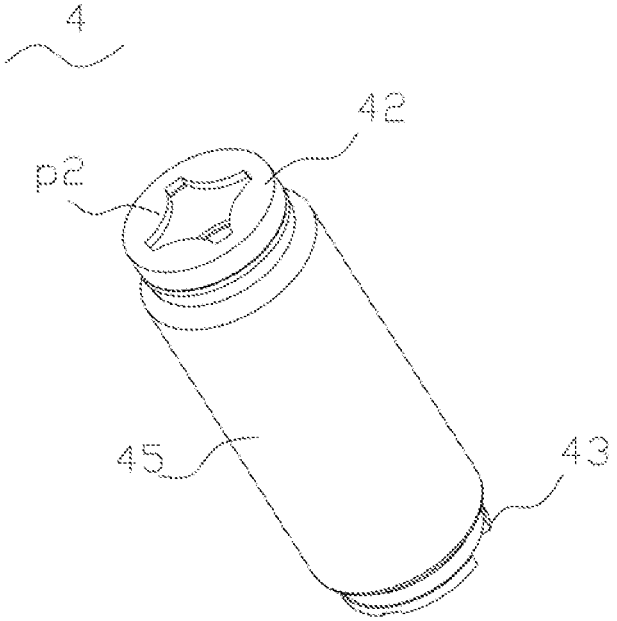
FIG. 4 is a perspective view of a heating assembly of the low-temperature smoking set shown in FIG. 1.
Figure 5:
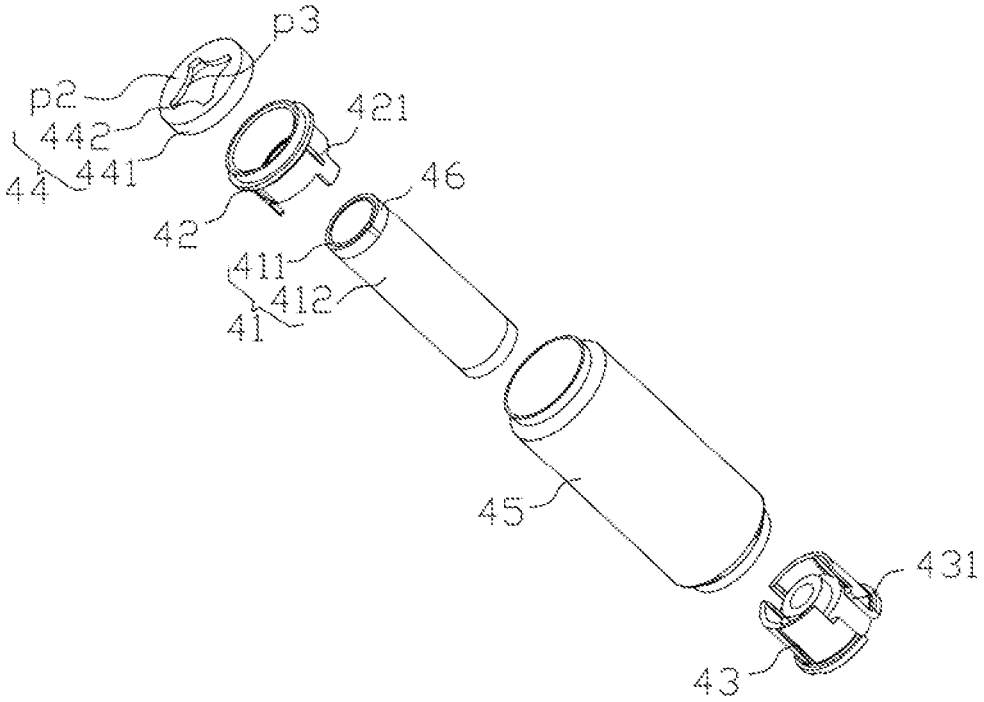
FIG. 5 is an exploded view of the heating assembly of the low-temperature smoking set shown in FIG. 1.
Figure 6:
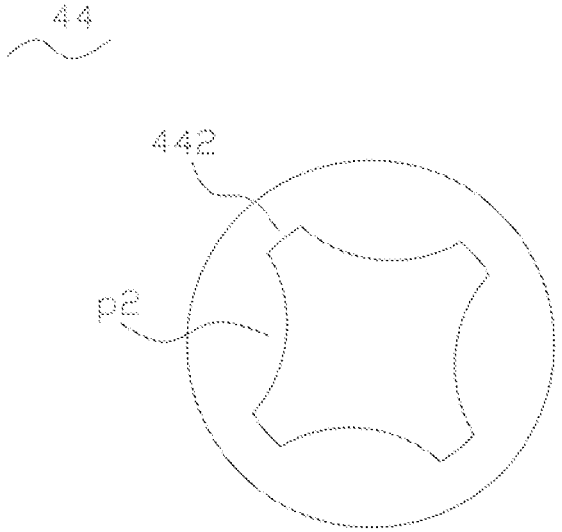
FIG. 6 is a perspective view of a fixing cap of the low-temperature smoking set shown in FIG. 1.
Figure 7:
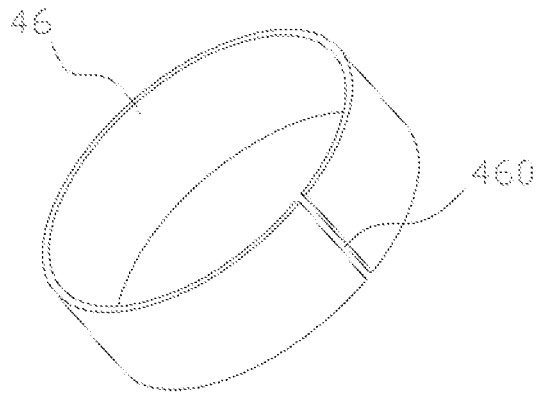
FIG. 7 is a perspective view of an electrode of the low-temperature smoking set shown in FIG. 1.

In order to facilitate the understanding of the present utility model, the present utility model will be described in more detail below with reference to attached drawings and detailed description.

Referring to FIG. 1 to FIG. 7, the present utility model provides a low-temperature smoking set, which comprises a housing assembly 1, a bracket 2, a battery 3 and a heating assembly 4, wherein the housing assembly 1 comprises a casing 11 and an end cover 12, and a key switch 5 electrically connected with the battery 3 and the heating assembly 4 is installed on the casing 11. The key switch 5 is configured to control the battery 3 to supply power to the heating assembly 4 so as to bake the cigarette 10. The end cover 12 covers one end face of the casing 11, and the end cover 12 is opened with an insertion hole 121 for the cigarette 10 to be inserted therein. The bracket 2 is accommodated in and connected with the casing 11, and the battery 3 is located in the casing 11 and mounted on the bracket 2.

In this embodiment, both the end cover 12 and the bracket 2 are detachably connected with the casing 11. In a certain embodiment, it may be unnecessary to provide the end cover 12, and the bracket 2 and the casing 11 are an integrally formed structure. Therefore, the structures of the housing assembly 1 and the bracket 2 are not particularly limited herein, as long as the battery 3 and the heating assembly 4 can be mounted.

The heating assembly 4 is configured to heat the cigarette, and it has a cigarette accommodating cavity P1 for the cigarette to be inserted therein. The cavity wall of the cigarette accommodating cavity P1 is provided with a plurality of elastic convex parts P2 arranged at intervals. The elastic convex parts P2 are sheet-shaped and extend along the transverse direction of the cigarette accommodating cavity P 1, and the elastic convex parts P2 are provided with arc-shaped abutting surfaces P3 for abutting against the cigarette 10. As shall be appreciated, the number of the elastic convex parts P2 is not particularly limited herein as well as the number is at least two.

In one embodiment, the elastic convex part P2 is arranged at the orifice of the insertion hole 121, and the insertion hole 121 serves as the mouth of the cigarette accommodating cavity P1; that is, the elastic convex part P2 is located at the mouth of the cigarette accommodating cavity Pl. In this way, the problem that the heat of the heating assembly 4 influences the elastic convex part P2 so that deformation occurs easily may be well avoided. Of course, the elastic convex part P2 may be located at or below the middle of the cigarette accommodating cavity P1, so the position thereof is not particularly limited herein.

In this embodiment, the heating assembly 4 comprises a heating body 41, a first fixing seat 42, a second fixing seat 43, a fixing cap 44, a heat insulation tube 45 and an electrode 46. The heating body 41 is configured to heat the cigarette 10, and the heating body 41 comprises a base 411 and an infrared radiation layer 412. The base 411 is a tubular structure and is used for accommodating the cigarette 10. The base 411 has opposite first and second ends, and a surface to which the infrared radiation layer 412 is attached. The base 411 extends in the longitudinal direction between the first and second ends, and a cavity 413 for accommodating the cigarette 10 is formed therein. In this embodiment, the peripheral surface of the base 411 is the surface to which the infrared radiation layer 412 is attached, i.e., the infrared radiation layer 412 is disposed on the surface.

The base 411 may be in cylindrical, prismatic or other columnar shapes. The base 411 is preferably cylindrical, then the cavity 413 is a cylindrical hole penetrating through the middle of the base 411, and the inner diameter of the hole is slightly larger than the outer diameter of the cigarette, so that it is convenient to place the cigarette in the cavity 413 to be heated. The base 411 may be made of high-temperature resistant and transparent materials such as quartz glass, ceramic or mica, or other materials with higher infrared transmittance, such as high-temperature resistant materials with infrared transmittance of more than 95%, and this is not particularly limited herein.

The infrared radiation layer 412 is electrically connected with the battery 3 through the electrode 46 and a wire electrically connected with the electrode 46. The infrared radiation layer 412 is configured to generate infrared radiation to heat at least a part of the cigarette 10 located in the cavity 413. In this embodiment, the infrared radiation layer 412 receives electric power to generate heat so as to generate infrared rays, and at least transmits the energy of the infrared rays to the cigarette 10 by radiation. The infrared radiation layer 412 may be a coating coated on the outer surface of the base 411 or a coating coated on the inner surface of the base 411. Preferably, the infrared radiation layer 412 is disposed on the outer surface of the base 411.

The infrared radiation layer 412 can generate heat energy when it is powered on so as to generate infrared rays with a certain wavelength, for example, far infrared rays of 8 μm to 15 μm. When the wavelength of the infrared rays matches the absorption wavelength of the cigarette, the energy of the infrared rays is easily absorbed by the cigarette. In the embodiment of the present application, the wavelength of the infrared rays is not limited, but the infrared rays may be infrared rays of 0.75 μm to 1000 μm, and preferably far infrared rays of 1.5 μm to 400 μm.

The infrared radiation layer 412 is preferably prepared by coating far infrared electrothermal ink, ceramic powder and inorganic adhesive, which are fully and uniformly stirred, on the outer surface of the base 411, and then drying and curing the resultant for a certain time. The thickness of the infrared radiation layer 412 is 30 μm to 50 μm. Of course, the infrared radiation layer 412 may also be prepared by coating tin tetrachloride, tin oxide, antimony trichloride, titanium tetrachloride and anhydrous copper sulfate, which are mixed at a certain proportion and stirred, on the outer surface of the base 411. Alternatively, the infrared radiation layer 412 is one of a silicon carbide ceramic layer, a carbon fiber composite layer, a zirconium titanium oxide ceramic layer, a zirconium titanium nitride ceramic layer, a zirconium titanium boride ceramic layer, a zirconium titanium carbide ceramic layer, an iron oxide ceramic layer, an iron nitride ceramic layer, an iron boride ceramic layer, an iron carbide ceramic layer, a rare earth oxide ceramic layer, a rare earth nitride ceramic layer, a rare earth boride ceramic layer, a rare earth carbide ceramic layer, a nickel cobalt oxide ceramic layer, a nickel cobalt nitride ceramic layer, a nickel cobalt boride ceramic layer, a nickel cobalt carbide ceramic layer or a high-silica zeolite ceramic layer. The infrared radiation layer 412 may also be an existing coating of other materials.

In one embodiment, the infrared radiation layer 412 is coated on the inner surface of the base 411, and the heating assembly 4 further comprises a protective layer coated on the infrared radiation layer 412 and/or a protective structure provided on the infrared radiation layer 412. The protective layer may be one or a combination of a polytetrafluoroethylene layer and a glaze layer, or a protective layer made of other high-temperature resistant materials. The protective structure may be an assembly or component that separates the cigarette from the infrared radiation layer 412, and there may be a gap between the protective structure and the infrared radiation layer 412 or the cigarette. The protective layer and/or the protective structure can avoid the abrasion of the infrared radiation layer 412 caused by for example the movement of the cigarette into and out of the cavity 413. As shall be appreciated, the infrared radiation layer 412 may also be a thin film with infrared radiation material that is attached on the surface of the base 411. In addition, the infrared radiation layer 412 may generate infrared rays when the infrared radiation layer 412 itself is powered on, or the infrared radiation layer 412 may generate infrared rays when it is excited by heat conduction from other heating devices, and this is not particularly limited herein.

The first fixing seat 42 is sleeved on the first end of the heating body 41 and connected with the heating body 41 and the housing assembly 1. The fixing cap 44 is detachably sleeved on the first fixing seat 42, so that it is convenient for replacement and maintenance. The fixing cap 44 comprises a collar part 441, a connection part 442 and elastic convex parts P2, wherein the collar part 441 is sleeved on the first fixing seat 42, and one end of the collar part 441 extends toward the axis of the collar part 441 to form a plurality of elastic convex parts P2, which are arranged at equal intervals. The elastic convex parts P2 are centrosymmetric about the center line of the cigarette accommodating cavity P1, so that when the cigarette 10 is clamped, the stress imposed on the cigarette 10 is uniform. The heating body 41, the first fixing seat 42 and the fixing cap 44 jointly define and form the cigarette accommodating cavity P1.

One end of the connection part 442 is connected to one of the elastic convex parts P2, and the other end of the connection part 442 is connected with another elastic convex part P2. That is, a connection part 442 is connected between adjacent elastic convex parts P2, and thus it is easier for the elastic convex parts P2 to reset when the cigarette is pulled out. Preferably, the collar part 441 is connected with the connection part 442, and the connection part 442 and the elastic convex parts P2 are located in the same plane, so that the resetting ability of the elastic convex parts P2 can be improved, and the service life can be prolonged. In this embodiment, the fixing cap 44 is made of silica gel material and it is an integrally formed structure, so it is convenient for manufacturing, and moreover, it is less likely to scratch the cigarette 10 when the cigarette is inserted. As shall be appreciated, the material of the fixing cap 44 is not particularly limited herein. In some embodiments, it may be unnecessary to provide the first fixing seat 42 or/and the fixing cap 44.

The cavity wall of the cigarette accommodating cavity P1 is provided with at least two elastic convex parts P2 which are arranged at intervals, the elastic convex parts P2 are sheet-shaped and extend along the transverse direction of the cigarette accommodating cavity P1, and the elastic convex parts P2 are provided with arc-shaped abutting surfaces P3 for abutting against the cigarette. Therefore, when a cigarette with a large diameter is inserted into the cigarette accommodating cavity P1, the elastic convex parts P2 are elastically deformed so that the cigarette can be inserted into the cigarette accommodating cavity P1. That is, self-adaptive adjustment according to the cigarette diameter is realized to adapt to cigarettes with different diameters. In addition, because the elastic convex parts P2 are sheet-shaped, it may well block heat dissipation and ensure the baking efficiency for the cigarette.

The peripheral surface of the first fixing seat 42 is provided with a plurality of convex ribs 421 which extend along the length direction of the first fixing seat 42. A wire groove 431 is provided on the peripheral surface of the second fixing seat 43, and the wire groove 431 extends along the length direction of the second fixing seat 43 and is used for the wires connected between the battery 3 and the electrode 46 to pass through. A first end of the heating body 41 is inserted into the first fixing seat 42, a second end of the heating body 41 is inserted into the second fixing seat 43, and the second fixing seat 43 is mounted on the bracket 2 so that the heating body 41 can be reliably fixed. A first end of the heat insulation tube 45 is sleeved on the convex rib 421 of the peripheral surface of the first fixing seat 42, a second end of the heat insulation tube 45 is sleeved on the peripheral surface of the second fixing seat 43, and a gap is formed between the heat insulation tube 45 and the heating body 41. In this way, outward radiation of heat may be prevented, and the user will not be scalded or feel discomfort due to the heat radiated outwards. With the arrangement of the convex ribs 421, the convex ribs 421 are deformed when the first end of the heat insulation tube 45 is sleeved on the second fixing seat 43, thereby facilitating the assembly.

The electrode 46 is partially recessed from the surface of the base 411 and buried in the base 411, and forms an integral structure with the base 411. For example, if the base 411 is made of a ceramic material, then in production, first the electrode 46 and the ceramic blank are sintered at high temperature to form an integral structure, and then the infrared radiation layer 412 is coated on the base 411 so that the electrode 46 and the infrared radiation layer 412 are electrically connected. In this way, the problem that the infrared radiation layer 412 is scraped off when the electrode 46 is mounted on the base 411 can be avoided. The electrode 46 has an opening 460 to form a non-closed ring shape, so that when the base 411 expands when it is heated, the electrode 46 will not be broken due to the expansion of the base 411.

Specifically, the number of the electrodes 46 is two, and the two electrodes 46 are respectively located at opposite ends of the base 411 and are respectively electrically connected with the positive and negative electrodes of the battery 3. Since the electrode 46 is in the non-closed ring shape, the fixation is stable. The infrared radiation layer 412 is formed on the peripheral surface of the base 411 and covers a part of the electrode 46. That is, the infrared radiation layer 412 is coated on part of area of the electrode 46 so that reliable electrical connection is achieved between the infrared radiation layer 412 and the electrode 46. Preferably, the infrared radiation layer 412 is tubular, and the diameter of the infrared radiation layer 412 is larger than the diameter of the electrode 46. The electrode 46 has a side that is substantially aligned with the surface of the base 411 on which the infrared radiation layer 412 is arranged, so it is easier to coat the infrared radiation layer 412 during production, and the infrared radiation layer 412 covers the electrode 46 conveniently. As shall be appreciated, the area of the electrode 46 covered by the infrared radiation layer 412 may be set as required, and this is not particularly limited herein.

Figure 8:
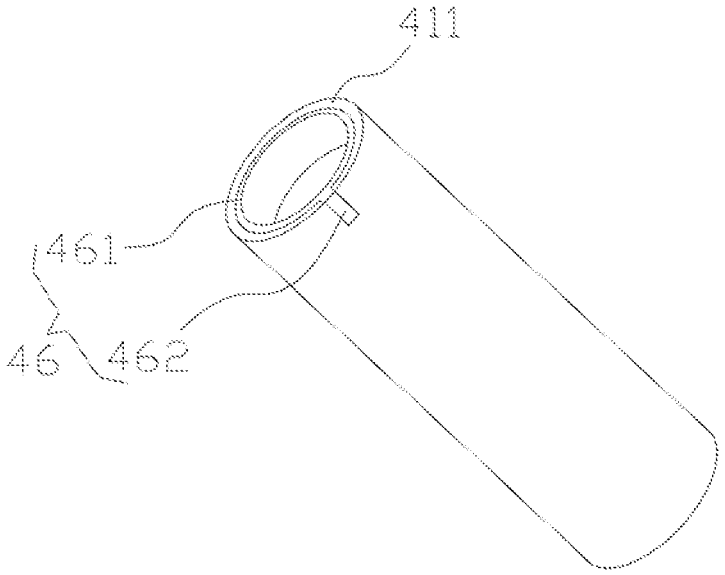
FIG. 8 is a perspective view of a heating body of a low-temperature smoking set provided according to yet another embodiment of the present utility model.

Please refer to FIG. 8, which is a perspective view of a heating body of a low-temperature smoking set provided according to yet another embodiment of the present utility model. In this embodiment, the base 411 is tubular with the cavity 413 formed inside, and the inner surface of the base 411 is configured as a surface on which the infrared radiation layer 412 is arranged. Part of the electrode 46 penetrates through the inner surface of the base 411 and extends to the outer surface of the base 411 so that it is convenient to be connected with wires by welding. Specifically, the electrode 46 comprises an annular body 461 and a tab 462, wherein the body 461 is recessed from the inner surface of the base 411 and buried in the base 411, and the tab 462 is connected with the body 461 and penetrates through the outer surface of the base 411. The tab 462 is used for connection with a wire by welding so as to be electrically connected to the battery 3. Preferably, the tab 462 penetrates through the outer surface of the base 41 and protrudes from the outer surface. Therefore, the structure is not particularly limited herein as long as the base 411 and the electrode 46 are an integrally formed structure.

Figure 9:
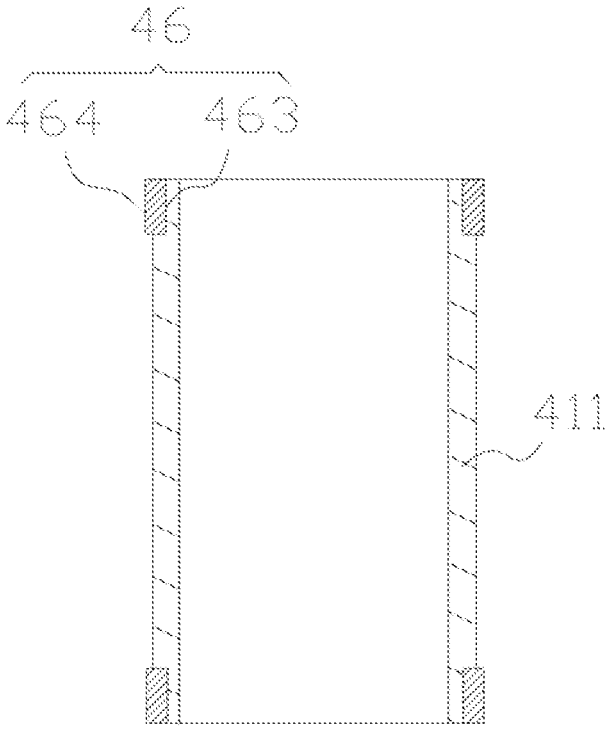
FIG. 9 is a perspective view of a heating body of a low-temperature smoking set provided according to yet another embodiment of the present utility model.

Please refer to FIG. 9, which is a perspective view of a heating body of a low- temperature smoking set provided according to yet another embodiment of the present utility model. The base 411 of this embodiment is tubular with the cavity 413 formed inside, and the outer surface of the base 411 is configured as a surface on which the infrared radiation layer 412 is arranged. The electrode 46 of this embodiment comprises a fixing ring 463 and an electrical connection part 464 located on the peripheral surface of the fixing ring 463. The fixing ring 463 is recessed from the outer surface of the base 411 and buried in the base 411 so that the electrode 46 and the base 411 are formed into an integral structure, and the electrical connection part 464 protrudes from the surface relative to the base 411. Specifically, the electrical connection part 464 forms a flange around the outer surface of the base 411, and is electrically connected with the wire through the flange so as to be electrically connected with the battery 3. Therefore, the arrangement of the flange facilitates the welding. Both ends of the base 411 are provided with the electrodes 46, and the infrared radiation layer 412 surrounds the outer surface of the base 411 and is located between the electrodes 46.

Figure 10:
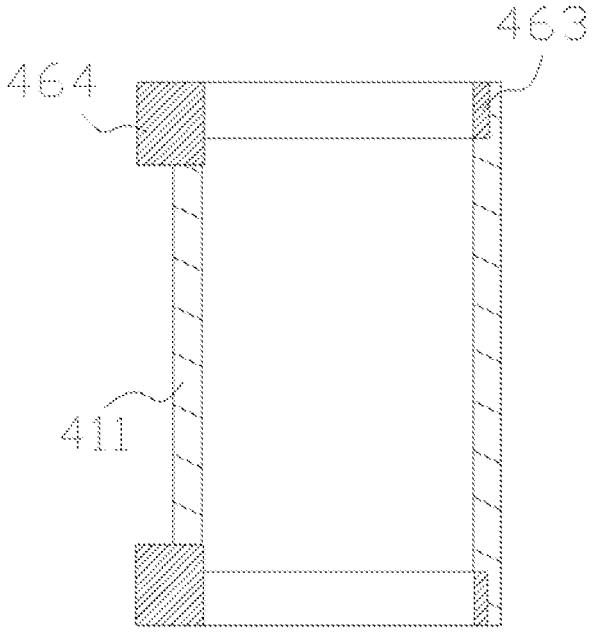
FIG. 10 is a perspective view of a heating body of a low-temperature smoking set provided according to yet another embodiment of the present utility model.

Referring to FIG. 10, which is a perspective view of a heating body of a low-temperature smoking set provided according to yet another embodiment of the present utility model. In this embodiment, the base 411 is tubular with the cavity 413 formed inside, and the inner surface of the base 411 is configured as a surface on which the infrared radiation layer 412 is arranged. The electrode 46 of this embodiment comprises a fixing ring 463 and an electrical connection part 464 for providing conductive connection between the heating assembly and other members. The fixing ring 463 is recessed from the inner surface of the base 411 and buried in the base 411 so that the electrode 46 and the base 411 are formed into an integral structure. The electrical connection part 464 protrudes from the outer surface of the base 411 relative to the base 411, which facilitates the welding. Specifically, the electrical connection part 464 is connected with a wire by welding so as to be electrically connected with the battery 3 through the wire.

According to the above description, in the present utility model, the base 411, the infrared radiation layer 412 and the electrodes 46 cooperate with each other, the base 411 comprises a surface, the infrared radiation layer 412 is arranged on the surface, and at least a part of the electrode 46 is recessed from the surface and buried in the base 411 so that the electrode 46 and the base 411 are formed into an integral structure; during production, first the electrode 46 and the base 411 are integrally formed, and then the infrared radiation layer 412 is formed on the base 411, thereby well preventing the infrared radiation layer 412 from being scraped off and preventing the electrodes 46 from falling off.

It shall be noted that, the specification and attached drawings of the present utility model show preferred embodiments of the present utility model, but the present utility model is not limited to the embodiments described in this specification. Further speaking, those of ordinary skill in the art can make improvements or variations according to the above description, and all these improvements and variations shall fall within the scope claimed in the appended claims of the present utility model.

What is claimed is:

1. A heating assembly for baking a cigarette, comprising a heating body and a cavity for containing at least a part of the cigarette, the heating body comprising a base formed as a tubular structure having the cavity formed therein, an infrared radiation layer and electrodes electrically connected with the infrared radiation layer, the base having an outer surface facing away from the cavity and an inner surface facing the cavity, and the base having a first end and a second end opposite to the first end along an extension direction of the base, the infrared radiation layer being disposed on a selective surface out of the outer surface and inner surface to cover the selective surface formed between the first end and the second end for generating infrared radiation to heat the at least a part of the cigarette located in the cavity; at least a part of each of the electrodes being disposed and buried in a part of the base which is disposed at a corresponding one of the first end and the second end, and is recessed from the selective surface toward an unselected surface out of the outer surface and the inner surface, so that the each electrode and the base are formed into an integral structure, and the each electrode is electrically connected with the infrared radiation layer for power supply to the infrared radiation layer.

2. The heating assembly according to claim 1, wherein the infrared radiation layer covers at least a part of the each electrode so as to be electrically connected with the each electrode.

3. The heating assembly according to claim 2, wherein at least a part of the each electrode has a side that is substantially aligned with the selective surface of the base.

4. The heating assembly according to claim 1, wherein the each electrode comprises an electrical connection part for providing conductive connection between the heating assembly and other members, and the electrical connection part protrudes from the selective surface relative to the base.

5. The heating assembly according to claim 4, wherein the outer surface of the base is configured as the selective surface, and the electrical connection part forms a flange around the outer surface of the base.

6. The heating assembly according to claim 1, wherein the each electrode has an opening to form a non-closed ring shape.

7. The heating assembly according to claim 1, wherein the inner surface of the base is configured as the selective surface, and at least a part of the each electrode penetrates through the inner surface of the base and extends to the outer surface of the base.

8. The heating assembly according to claim 7, wherein the each electrode comprises an annular body and a tab, and the annular body is embedded into the inner surface of the base and buried in the base; the tab is connected with the annular body, penetrates through the base and protrudes from the outer surface.

9. The heating assembly according to claim 1, wherein the number of the electrodes is two, and the two electrodes are correspondingly located at the opposite first and second ends of the base.

10. The heating assembly according to claim 1, wherein a plurality of elastic convex parts are disposed at the inner surface of the cavity at interval, and each of the plurality of elastic convex parts extends along a transverse direction of the cavity to be closer to one another.

11. The heating assembly according to claim 10, wherein an arc-shaped abutting surface is formed at a side of the each of the plurality of elastic convex parts facing a center of the cavity.

12. The heating assembly according to claim 1, wherein the base is made from a material having an infrared transmittance of more than 95%.

13. The heating assembly according to claim 1, wherein the infrared radiation layer is configured to generate infrared rays with a wavelength ranged from 0.75 μm to 1000 μm.

14. The heating assembly according to claim 1, wherein a thickness of the infrared radiation layer is ranged from 30 μm to 50 μm.

15. A low-temperature smoking set, comprising a housing assembly and a heating assembly, the heating assembly being accommodated in the housing assembly, the heating assembly being the heating assembly according to claim 1.

* * * * *